United States Patent [19]

Stewart

[11] 4,133,381

[45] Jan. 9, 1979

[54] CONTACTING TREATED OIL SHALE WITH CARBON DIOXIDE TO INHIBIT LEACHING

[75] Inventor: Robert D. Stewart, Yorba Linda, Calif.

[73] Assignee: Occidental Oil Shale, Inc., Grand Junction, Colo.

[21] Appl. No.: 864,453

[22] Filed: Dec. 27, 1977

[51] Int. Cl.[2] ..... E21B 43/24; C01F 11/18

[52] U.S. Cl. ..... 166/261; 166/259; 166/288; 166/303; 208/11 R; 423/155

[58] Field of Search ..... 166/288, 259, 261, 256, 166/272, 303; 299/2; 423/155, 165, 430; 208/11 R

[56] References Cited

U.S. PATENT DOCUMENTS

| | | | |
|---|---|---|---|
| 1,913,395 | 6/1933 | Karrick | 299/2 |
| 3,454,958 | 7/1969 | Parker | 166/303 |
| 3,480,082 | 11/1969 | Gilliland | 208/11 R X |
| 3,617,466 | 11/1971 | Todd | 208/11 R |
| 3,994,343 | 11/1976 | Cha et al. | 208/11 R X |
| 4,014,575 | 3/1977 | French et al. | 299/2 |
| 4,016,239 | 4/1977 | Fenton | 423/155 |

OTHER PUBLICATIONS

*Lawrence Livermore Laboratory – Oil Shale Project Quarterly Report*, Jan. 25, 1977, (Report for Oct. – Dec. 1976).

*Primary Examiner*—Stephen J. Novosad
*Attorney, Agent, or Firm*—Christie, Parker & Hale

[57] ABSTRACT

Leaching of water-soluble constituents from particles containing treated oil shale and including oxides of alkaline earth metals, such as particles in an in situ oil shale retort, is inhibited by contacting the particles with carbon dioxide in the presence of water for a sufficient time to produce a substantially water-insoluble and/or impermeable barrier of carbonates of alkaline earth metals at the surface of the particles.

18 Claims, 1 Drawing Figure

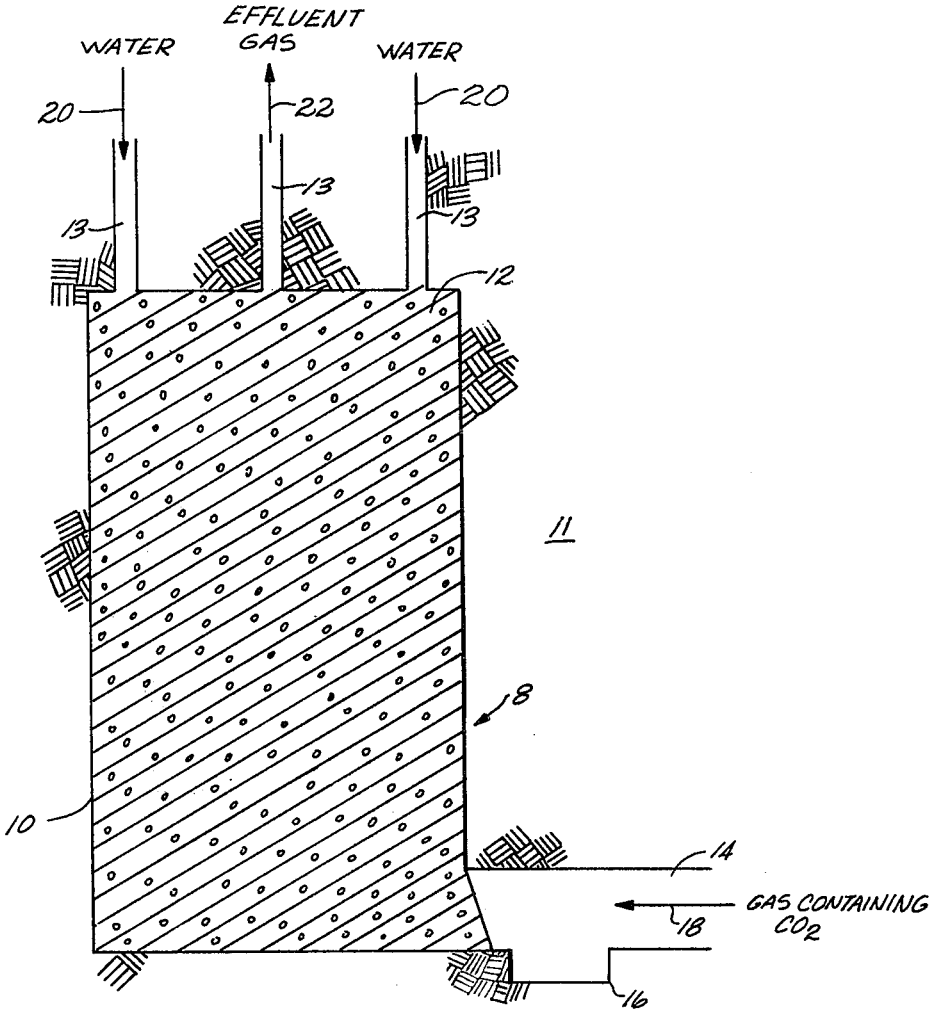
EFFLUENT GAS
WATER
WATER
20
22
20
13
13
13
12
11
8
10
14
GAS CONTAINING $CO_2$
18
16

CONTACTING TREATED OIL SHALE WITH CARBON DIOXIDE TO INHIBIT LEACHING

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale, nor does it contain oil. It is a sedimentary formation comprising marlstone deposit and including dolomite with layers containing an organic polymer called "kerogen", which, upon heating, decomposes to produce liquid and gaseous products. It is the formation containing kerogen that is called "oil shale" herein, and the liquid hydrocarbon product is called "shale oil".

A number of methods have been proposed for processing the oil shale which involve either first mining the kerogen-bearing shale and processing the shale on the surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598, which are incorporated herein by this reference. Such patents describe in situ recovery of liquid and gaseous hydrocarbon materials from a subterranean formation containing oil shale by fragmenting such formation to form a stationary, fragmented permeable body or mass of formation particles containing oil shale within the formation, referred to herein as an in situ oil shale retort. Hot retorting gases are passed through the in situ oil shale retort to convert kerogen contained in the oil shale to liquid and gaseous products, thereby producing retorted oil shale.

One method of supplying hot retorting gases used for converting kerogen contained in the oil shale, as described in U.S. Pat. No. 3,661,423, includes establishment of a combustion zone in the retort and introduction of an oxygen-containing retort inlet mixture into the retort as an oxygen-supplying gaseous combustion zone feed to advance the combustion zone through the retort. In the combustion zone, oxygen in the combustion zone feed is depleted by reaction with hot carbonaceous materials to produce heat, combustion gas, and combusted oil shale. Temperatures are attained in the combustion zone sufficiently high to decompose carbonates of alkaline earth metals in oil shale to the corresponding oxides of alkaline earth metals. By the continued introduction of the retort inlet mixture into the retort, the combustion zone is advanced through the fragmented mass in the retort.

The combustion gas and the portion of the combustion zone feed that does not take part in the combustion process pass through the fragmented mass in the retort on the advancing side of the combustion zone to heat the oil shale in a retorting zone to a temperature sufficient to produce kerogen decomposition, called retorting, in the oil shale to gaseous and liquid products, including gaseous and liquid hydrocarbon products, and to a residual solid carbonaceous material.

The liquid products and gaseous products are cooled by the cooler oil shale fragments in the retort on the advancing side of the retorting zone. The liquid hydrocarbon products, together with water produced in or added to the retort, are collected at the bottom of the retort. An off gas containing combustion gas, including carbon dioxide generated in the combustion zone, gaseous products produced in the retorting zone, carbon dioxide from carbonate decomposition, and any gaseous retort inlet mixture that does not take part in the combustion process, is also withdrawn from the bottom of the retort. The products of retorting are referred to herein as liquid and gaseous products.

Residual carbonaceous material in the retorted oil shale can be used as fuel for advancing the combustion zone through the retorted oil shale. When the residual carbonaceous material is heated to its spontaneous ignition temperature, it reacts with oxygen. As the residual carbonaceous material becomes depleted in the combustion process, the oxygen penetrates farther into the oil shale retort where it combines with remaining unoxidized residual carbonaceous material, thereby causing the combustion zone to advance through the fragmented oil shale.

At the end of retorting, a retort can contain a substantial quantity of oxides of alkaline earth metals formed by decomposition of carbonates of alkaline earth metals in oil shale. Concern has been expressed that these oxides of alkaline earth metals, as well as other water-soluble constituents of combusted oil shale, can be leached by ground water, thereby contaminating ground water. A high level of contaminants in ground water can make it unsuitable for some uses, including domestic uses.

SUMMARY

According to the present invention, a method is provided for inhibiting leaching of water-soluble constituents from a fragmented permeable mass of particles containing treated oil shale, such as combusted oil shale, and including oxides of alkaline earth metals. According to this method, both water and gas containing carbon dioxide are introduced to the fragmented mass. Introduced carbon dioxide reacts with alkaline earth metal oxides in the presence of introduced water. The gas containing carbon dioxide is introduced to the fragmented permeable mass for a sufficient time to produce a substantially water-insoluble barrier comprising carbonates of alkaline earth metals at the surface of particles of treated oil shale in the fragmented mass. The gas containing carbon dioxide introduced to the fragmented mass can be off gas from an in situ oil shale retort.

DRAWINGS

These and other features, aspects, and advantages of the present invention will become more apparent with respect to the following description, appended claims, and accompanying drawing, which schematically represents in vertical cross-section an in situ oil shale retort containing particles containing combusted oil shale, the particles being treated to inhibit leaching of water-soluble constituents from the retort.

DESCRIPTION

Referring to the drawing, in an embodiment of this invention an already retorted in situ oil shale retort 8 is in the form of a cavity 10 formed in an unfragmented subterranean formation 11 containing oil shale. The cavity contains an expanded and fragmented permeable mass 12 of formation particles. The cavity 10 can be created simultaneously with fragmentation of the mass of formation particles 12 by blasting by any of a variety of techniques. Methods for forming an in situ oil retort are described in the aforementioned U.S. Pat. Nos. 3,661,423; 4,043,595; 4,043,596; 4,043,597; and 4,043,598.

One or more conduits 13 communicate with the top of the fragmented mass of formation particles. During the retorting operation of the retort 8, a combustion zone is established in the retort and advanced by introducing a gaseous feed containing an oxygen supplying gas, such as air or air mixed with other gases, into the in situ oil shale retort through the conduits 13. As the gaseous feed is introduced to the retort, oxygen oxidizes carbonaceous material in the oil shale to produce combusted oil shale and combustion gas. Heat from the exothermic oxidation reactions carried by flowing gases advances the combustion zone downwardly through the fragmented mass of particles.

Combustion gas produced in the combustion zone, any unreacted portion of the oxygen supplying gaseous feed, and gases from carbonate decomposition are passed through the fragmented mass of particles on the advancing side of the combustion zone to establish a retorting zone on the advancing side of the combustion zone. Kerogen in the oil shale is retorted in the retorting zone to yield retorted oil shale and liquid and gaseous products, including hydrocarbons.

There is a drift 14, or the like, in communication with the bottom of the retort. The drift contains a sump 16 in which liquid products are collected to be withdrawn for further processing. An off gas containing gaseous products, combustion gas, gases from carbonate decomposition, and any unreacted portion of the gaseous combustion zone feed is also withdrawn from the in situ oil shale retort 8 by way of the drift 14. The off gas can contain large amounts of nitrogen with lesser amounts of hydrogen, carbon monoxide, carbon dioxide, methane and higher hydrocarbons, water vapor, and sulfur compounds, such as hydrogen sulfide. For example, an off gas from an in situ oil shale retort can contain about 30% by volume on a dry basis carbon dioxide.

At the end of retorting operations, at least part of the oil shale in the retort 8 is at an elevated temperature which can be in excess of about 1000° F. The hottest region of the retort is often near the bottom, and a somewhat cooler region is at the top, due to continual cooling by gaseous feed containing oxygen during retorting and conduction of heat to adjacent shale. The oil shale in the retort 8 gradually cools toward ambient temperature when retorting and combustion are complete.

The retort illustrated in the drawing has had retorting and combustion operations completed and contains a fragmented permeable mass of formation particles containing combusted oil shale. As used herein the term "retorted oil shale" refers to oil shale heated to sufficient temperature to decompose kerogen in an environment substantially free of free oxygen so as to leave a solid carbonaceous residue. The term "combusted oil shale" refers to oil shale of reduced carbon content due to oxidation by a gas containing free oxygen. The term "treated oil shale" refers to oil shale treated to remove organic materials and includes retorted and/or combusted oil shale. An individual particle containing oil shale can have a core of retorted oil shale and an outer "shell" of combusted oil shale. Such can occur when oxygen has diffused only part way through the particle during the time it is at an elevated temperature and in contact with an oxygen supplying gas.

Oil shale contains large quantities of alkaline earth metal carbonates, principally carbonates of calcium and magnesium, which, during retorting and combustion, are at least partly calcined to produce alkaline earth metal oxides. For example, oil shale particles in the retort 8 can contain approximately 8 to 12 weight percent calcium and 1.5 to 3 weight percent magnesium present as carbonates before retorting.

Magnesium and calcium carbonate can be present initially in the formation in a variety of mineral forms of varying compositions, such as magnesite, brucite, dolomite, ferroan, and ankerite. In stoichiometric dolomite, there is one magnesium atom per calcium atom. Calcium-rich dolomites, having ratios of magnesium to calcium of less than one, can also occur. The aforementioned mineral forms and others, including illite, drawsonite, analcime, aragonite, calcite, quartz, potassium feldspar, sodium feldspar, nahcolite, siderite, pyrite, and fluorite, have been identified in oil shale by x-ray diffraction analysis. The presence of such mineral forms in oil shale has been reported in W. Robb et al, "Mineral Profile of Oil Shales in Colorado Core Hole No. 1, Piceance Creek Basin, Colorado", *Energy Resources of the Piceance Creek Basin, Colorado*, D. Keith Murray, Ed. Rocky Mountain Association of Geologists, Denver, Colorado, pages 91–100 (1974) and E. Cook, "Thermal Analysis of Oil Shales", *Quarterly of the Colorado School of Mines*, Vol. 65, pages 133–140 (1970).

The Cook article states that dolomite in oil shale in the Green River formation, which includes the Piceance Creek Basin, is actually in the form of ankerite and, therefore, has a lower decomposition temperature than pure iron-free dolomite. The minerals in oil shale are present in very fine crystals in various intimate admixtures and can interact during retorting and combustion. Thus, minerals such as dolomite in oil shale are not expected to behave the same as more pure forms of the mineral. In addition, as stated in the Cook article, it is difficult to predict the temperature range or the extent of carbonate decomposition during retorting of oil shale, because carbonate decompositions are dependent in part on the partial pressure of carbon dioxide in the retort atmosphere.

There can be a substantial amount of ground water in subterranean formations containing oil shale. Concern has been expressed that this ground water can become contaminated by leaching of water-soluble constituents, such as oxides of alkaline earth metals and compounds containing sodium and potassium, from treated oil shale.

Therefore, according to the present invention, to inhibit leaching of water-soluble constituents from treated oil shale, gas 18 containing carbon dioxide, such as off gas from an active in situ oil shale retort, and water 20 are introduced to the already treated retort 8. Carbon dioxide introduced to the retort 8 combines with oxides of alkaline earth metals in the presence of water introduced to the retort to produce a substantially water-insoluble and/or impermeable barrier comprising carbonates of alkaline earth metals at the surface of particles of treated oil shale in the fragmented mass 12. It is believed that alkaline earth metal oxides and carbon dioxide combine according to the following reaction:

$$MO + CO_2 \rightarrow MCO_3$$

where M represents an alkaline earth metal. Water introduced to the retort is believed to enhance the rate of reaction of carbon dioxide with oxides of alkaline earth metals.

It is believed that leaching from combusted oil shale in the retort 8 is inhibited in at least two ways by combining oxides of alkaline earth metals with carbon dioxide. First, oxides of alkaline earth metals which are converted to the corresponding carbonates of alkaline earth metals are themselves insolubilized, because the solubility of carbonates of alkaline earth metals, such as calcium carbonate, is substantially less than the solubility of the corresponding hydroxides of alkaline earth metals, which are formed when an alkaline earth metal is exposed to water. For example, the solubility of calcium hydroxide in 0° C. water is 0.185 parts by weight per 100 parts by weight water, while the solubility of calcium carbonate (calcite) in 25° C. water is only 0.0014 parts by weight per 100 parts by weight water. It should be noted that the solubility of magnesium carbonate in water is higher than the solubility of magnesium hydroxide. However, since oil shale contains substantially more calcium than magnesium, a total decrease in the solubility of alkaline earth metals present in combusted oil shale is obtained by converting oxides of alkaline earth metals in combusted oil shale to the corresponding carbonates of the alkaline earth metals.

A second way combining alkaline earth metal oxides in treated oil shale with carbon dioxide serves to inhibit leaching of water-soluble constituents from treated oil shale is by forming a substantially water-insoluble barrier comprising carbonates of alkaline earth metals at the surface of particles of treated oil shale. Treated oil shale is relatively permeable, and such a barrier at the surfaces of the particles is relatively impermeable to water. This barrier inhibits water from reaching water-soluble constituents, including water-soluble compounds of sodium, potassium, calcium, and magnesium present in the core portion of oil shale particles in the fragmented mass.

There is sufficient differential pressure between the top and bottom of the retort to cause the gas 18 containing carbon dioxide to flow through the drift 14, which is in communication with the bottom of the retort, and upwardly through the retort 8 to be withdrawn from the retort through the conduits 13, which are in communication with the upper boundary of the fragmented mass of treated oil shale particles in the retort 8. The partial pressure of carbon dioxide in the retort can be less than one atmosphere. For economy, a conduit 13 used for introducing oxygen supplying gaseous feed to the retort 8 during the retorting operation is utilized to withdraw effluent gas 22 from the retort. Similarly, the drift 14 used for withdrawing off gas from the retort 8 during the retorting operation is utilized for introducing the gas stream 18 to the retort. Likewise, a conduit 13 used for introducing oxygen supplying gaseous feed to the retort 8 during the retorting operation can be utilized for introducing water 20 to the fragmented mass. If desired, the carbon dioxide containing gas 18 can be introduced to the retort 8 through the conduit 13 and the effluent gas 23 can be withdrawn from the retort via the drift 14.

The water for introduction to the retort 8 can be vaporized or liquid. The water can be provided by any suitable method, such as by mixing steam or a mist of water droplets with the carbon dioxide containing gas 18 prior to introducing it into the retort. Alternatively, as shown in the drawing, the water can be introduced into the retort 8 separately from the carbon dioxide containing gas via a conduit 13. The water can be injected through the conduit into the top of the retort 8 in the form of a fine stream, a spray, a mist, or steam. The water can be introduced into the retort 8 at the same time as, or prior to, introduction of the carbon dioxide containing gas to the retort 8. Water can be introduced to the retort continuously or intermittently.

The reaction between carbon dioxide and oxides of alkaline earth metals occurs faster in the presence of liquid water than in the presence of steam. Therefore, when steam is introduced, preferably the steam condenses on cool particles in the fragmented mass which are at a temperature less than the boiling point of water. Cool particles are present in the fragmented mass because the mass cools toward ambient temperature when processing of the oil shale in completed. Also, introduction of fluids, such as the water and carbon dioxide containing gas, can hasten the cooling of the fragmented mass.

The carbon dioxide containing gas can be obtained from any suitable source, such as flue gas from a steam plant, or carbon dioxide generated by burning shale oil. Preferably, the carbon dioxide containing gas is off gas from an in situ oil shale retort, because such gas is readily available and can contain more than 30% carbon dioxide by volume on a dry basis. Removal of carbon dioxide from the off gas serves to increase the heating value of the off gas, thereby making the off gas more valuable as a fuel. In addition, off gas is generally saturated with water vapor. Therefore, the off gas can supply a portion of the water introduced to the fragmented mass.

When it is desired that the carbon dioxide containing gas have a relatively high carbon dioxide concentration, or be substantially pure carbon dioxide, carbon dioxide can be scrubbed by conventional techniques from retort off gas or other carbon dioxide containing gas.

Preferably sufficient water is introduced to the fragmented mass to at least wet the surface of the particles in the fragmented mass exposed to carbon dioxide, after allowing for water absorbed by the particles. Combusted oil shale can absorb water in an amount equal to about 20% of its own weight. It is believed the presence of water in the fragmented mass enhances the reaction of carbon dioxide with oxides of alkaline earth metals in treated oil shale.

The rate of reaction between carbon dioxide and oxides of alkaline earth metals increases as temperature increases. Therefore, preferably at least a portion of the fragmented mass has a temperature greater than ambient temperature, but less than about the boiling point of water, when carbon dioxide is introduced to the retort. Thus, the carbon dioxide containing gas can be introduced to the fragmented mass while the fragmented mass has a residual temperature from combustion greater than ambient temperature.

If the effluent gas 22 withdrawn from the retort contains appreciable amounts of carbon dioxide, it can be recirculated through the retort 8.

The carbon dioxide containing gas is introduced to the retort 8 for sufficient time to produce a substantially water-insoluble barrier comprising carbonates of alkaline earth metals on the particles in the fragmented mass. To determine when sufficient carbon dioxide has been introduced to the retort, the amount of carbon dioxide withdrawn from the retort in the effluent gas 22 can be compared to the amount of carbon dioxide introduced to the retort in the carbon dioxide containing gas 18. Taking the difference between these two amounts yields the consumption of carbon dioxide in the retort 8. As carbon dioxide containing gas is introduced to the retort, the rate of consumption decreases, until eventually all the oxides of alkaline earth metals are converted to carbonates of alkaline earth metals. When this occurs, the rate of consumption of carbon dioxide falls to zero. Therefore, by monitoring the concentration of carbon dioxide and the rate of introduction of both the gas containing carbon dioxide and the effluent gas, it is possible to determine when introduction of carbon dioxide containing gas to the retort 8 can be stopped.

However, it is not necessary to convert all of the oxides of alkaline earth metals in the retort 8 to the corresponding carbonates of alkaline earth metals. It is only necessary to form a water-insoluble barrier on the bulk of the particles in the retort. Therefore, when the consumption of the carbon dioxide decreases substantially, introduction of gas containing carbon dioxide to the retort 8 can be stopped.

Preferably the carbon dioxide containing gas is introduced to flow from a hotter portion of the fragmented permeable mass in the retort 8 towards cooler portions to minimize pressure drop through the retort and the cost of passing gas through the retort. By introducing the gas to the hotter portion of the retort, heat is transferred by the flowing gas to the cooler portions of the retort, with the result that the fragmented permeable mass eventually has no hot spot. The absence of a hot spot results in reduced pressure drop across the fragmented mass, because the volumetric flow rate of the gas through the retort decreases as the temperature of the fragmented mass decreases. Also, the void fraction of the fragmented permeable mass increases due to thermal contraction of the formation particles as the mass of particles cools. Thus, without a hot spot, there is no portion of the fragmented mass which has only a small cross-sectional area available for flow of gas through the retort.

Therefore, as shown in the drawing, when a fragmented permeable mass in an in situ oil shale retort is retorted from top to bottom, preferably the carbon dioxide containing gas is introduced to the bottom of the retort, and effluent gas is withdrawn from the top of the retort. An advantage of introducing the gas to the bottom of the retort, as shown in the drawing, is that off gas from the bottom of an adjacent active in situ oil shale retort can be directly introduced to the bottom of the treated retort 8 without having to incur the capital and operating expenses of transferring the off gas to the top of the nearby treated retort.

These and other features of the present invention will be better understood with reference to the following example.

Example

Tests were conducted to determine the effects of treating combusted oil shale with carbon dioxide and steam on the ability of water to leach constituents from combusted oil shale.

Two combusted oil shale samples, Samples A and B, were prepared by combustion of $-3+8$ mesh oil shale in a laboratory retort at about 1500° F. To inhibit leaching of water-soluble constituents from Sample B, it was exposed to a gas containing 81% carbon dioxide and 19% water by volume for 24 hours at 850° F. Sample B changed color from a light, dirty brown to a light grey during the exposure. Testing was performed by placing about 300 grams of each sample in a 10-inch long, 1-inch diameter, vertical glass tube.

Leach water was pumped with a tubing pump, using Tygon tubing from closed, glass storage containers, to the top of each shale column. Water trickling through to the bottom of each column was recirculated. Samples of the water from each column were taken simultaneously at regular intervals, and a comparable quantity of distilled water was added to restore the original water volumes in each system. At the end of seven days of leaching, the residual water in the two systems was analyzed. The results are shown in Table 1.

The results presented in Table 1 show about a 20% decrease in Na, K, and Ca, and an 80% decrease in total alkalinity (determined as calcium carbonate) in the leach water from Sample B compared to the leach water from Sample A.

Table 1

| | | Material Leached from Combusted Shale | | | | |
|---|---|---|---|---|---|---|
| Sample | Treatment | Total Alkalinity*1) as $CaCO_3$ | Na* | K* | Ca* | As* |
| A | None | $6.2\ 10^{-3}$ | $1.75 \times 10^{-3}$ | $6.8 \times 10^{-4}$ | $7.9 \times 10^{-4}$ | None |
| B | $CO_2 + H_2O$ | $1.6 \times 10^{-3}$ | $1.36 \times 10^{-3}$ | $5.4 \times 10^{-4}$ | $6.4 \times 10^{-4}$ | None |

*Weight of material leached per unit weight of shale.
1)includes Mg

The method of this invention provides a simple and effective process for inhibiting leaching of water-soluble constituents from treated oil shale. It is an inexpensive method, because it utilizes materials which are readily available at a retort site, namely water and carbon dioxide containing gas. Furthermore, the method also utilizes piping already installed for operation of the retort and utilizes the residual heat in the fragmented mass from the retorting operation. Therefore, special raw materials, special piping, and heating of water and carbon dioxide containing gas are not required. All this contributes to the simplicity and effectiveness of the operation.

Although this invention has been described in considerable detail with reference to certain versions thereof, other versions are possible. Therefore, the spirit and scope of the appended claims should not necessarily be limited to the description of the versions contained herein.

What is claimed is:

1. A method for recovering liquid and gaseous products from a first in situ oil shale retort in a subterranean formation containing oil shale, said first in situ retort containing a fragmented permeable mass of particles containing oil shale including carbonates of alkaline earth metals, comprising the steps of:

(a) establishing a combustion zone in the fragmented mass in the first in situ retort;

(b ) introducing a combustion zone feed comprising oxygen to the combustion zone in the first in situ oil shale retort for advancing the combustion zone through the fragmented mass of particles, for producing combustion gas comprising carbon dioxide, and for producing combusted oil shale in the combustion zone, wherein at least a portion of the carbonates of alkaline earth metals are decomposed to oxides of alkaline earth metals and carbon dioxide;

(c) passing said combustion gas and any unreacted portion of the combustion zone feed through a retorting zone in the fragmented mass of particles on the advancing side of the combustion zone, wherein oil shale is retorted and liquid and gaseous products are produced;

(d) withdrawing liquid products from the first in situ oil shale retort from the advancing side of the retorting zone;

(e) withdrawing a retort off gas comprising said gaseous products, combustion gas including carbon dioxide, gaseous unreacted portions of the combustion zone feed, and carbon dioxide from decomposition of oxides of alkaline earth metals from the first in situ oil shale retort from the advancing side of the retorting zone;

(f) stopping introduction of the combustion zone feed to the combustion zone for ending advancement of the combustion zone through the fragmented mass; and thereafter (g) inhibiting leaching of alkaline earth metals from combusted oil shale particles in the first retort by the steps of:

(i) introducing a gaseous combustion zone feed containing oxygen to a combustion zone in a second in situ oil shale retort in a subterranean formation containing oil shale and including carbonates of alkaline earth metals, said second in situ retort containing a fragmented permeable mass of formation particles containing oil shale and carbonates of alkaline earth metals, wherein the gaseous combustion zone feed advances the combustion zone through the fragmented mass of particles and decomposes at least a portion of the carbonates of alkaline earth metals to oxides of alkaline earth metals and carbon dioxide and produces combustion gas comprising carbon dioxide;

(ii) withdrawing off gas containing carbon dioxide from the second retort;

(iii) introducing water to the fragmented mass containing combusted oil shale in the first in situ oil shale retort; and (iv) introducing off gas withdrawn from the second retort to the first retort for combining carbon dioxide of the off gas withdrawn from the second retort with oxides of alkaline earth metals in the first retort at a partial pressure of carbon dioxide of less than one atmosphere in the presence of water introduced to the first retort for a sufficient time to produce a substantially water-insoluble barrier comprising carbonates of alkaline earth metals at the surface of particles of combusted oil shale in the first retort.

2. The method of claim 1 in which the water introduced to the fragmented mass in the first retort comprises liquid water.

3. A method for inhibiting leaching of water-soluble constituents from a particle containing treated oil shale and including oxides of alkaline earth metals comprising the steps of contacting such a particle with steam and contacting such particle with carbon dioxide for a sufficient time to produce a substantially water-insoluble barrier comprising carbonates of alkaline earth metal at the surface of the particle.

4. The method of claim 3 in which such particle is contacted with steam and carbon dioxide at substantially the same time.

5. The method of claim 4 in which such particle is contacted with carbon dioxide and steam at a temperature of about 850° F. for about 24 hours.

6. The method of claim 3 in which such particle comprises combusted oil shale.

7. The method of claim 3 in which such particle is contacted with off gas from an in situ oil shale retort, the off gas containing carbon dioxide, wherein the particle is contacted with carbon dioxide at a partial pressure of carbon dioxide of less than one atmosphere.

8. A method of inhibiting leaching of watersoluble constituents from a fragmented permeable mass of particles containing combusted oil shale and including oxides of alkaline earth metals, the fragmented mass being in an in situ oil shale retort, comprising the step of contacting oxides of alkaline earth metals in the fragmented permeable mass with carbon dioxide in the presence of water for a sufficient time to produce a substantially water-insoluble barrier comprising carbonates of alkaline earth metal at the surface of the particle.

9. The method of claim 8 in which at least a portion of the fragmented permeable mass has a residual temperature from combustion greater than ambient temperature.

10. The method of claim 8 in which the step of contacting alkaline earth metal oxides with carbon dioxide comprises introducing retort off gas containing carbon dioxide to the fragmented mass, the partial pressure of carbon dioxide in the retort being less than one atmosphere.

11. A method for inhibiting leaching of water-soluble constituents from a fragmented permeable mass of formation particles containing combusted oil shale and including oxides of alkaline earth metals, the fragmented mass being in an in situ oil shale retort, the method comprising the steps of:

introducing steam to the fragmented permeable mass; and introducing gas containing carbon dioxide to the fragmented permeable mass for reaction of the carbon dioxide with such oxides of alkaline earth metals in the presence of introduced steam for a sufficient time to produce a substantially water-insoluble barrier comprising carbonates of alkaline earth metals.

12. The method of claim 11 in which steam is introduced to the top of the fragmented permeable mass.

13. The method of claim 12 in which gas containing carbon dioxide is introduced to the bottom of the fragmented permeable mass.

14. The method of claim 11 in which the step of introducing water comprises introducing steam having a temperature of about 850° F.

15. The method of claim 11 in which at least a portion of the gas containing carbon dioxide is off gas from an in situ oil shale retort.

16. A method for inhibiting leaching of water-soluble constituents from a fragmented permeable mass of particles containing combusted oil shale and including calcium oxide, comprising the step of contacting calcium oxide in the fragmented permeable mass with carbon dioxide in the presence of steam at a temperature of about 850° F. for about 24 hours to produce a substantially water-insoluble barrier comprising calcium carbonate at the surface of the particles.

17. The method of claim 16 in which at least a portion of the fragmented permeable mass has a residual temperature from combustion greater than ambient temperature.

18. The method of claim 16 in which the step of contacting calcium oxide with carbon dioxide comprises introducing retort off gas containing carbon dioxide to the fragmented mass and contacting calcium oxide with carbon dioxide at a partial pressure of carbon dioxide of less than one atmosphere.

* * * * *